US005844863A

United States Patent [19]

Voss et al.

[11] Patent Number: 5,844,863

[45] Date of Patent: Dec. 1, 1998

[54] MODULAR TIME PIECE

[76] Inventors: Wolf-Dieter Voss; Claudia Voss, both of 2 Sunset Harbor, Newport Coast, Calif. 92657

[21] Appl. No.: 808,174

[22] Filed: Feb. 28, 1997

[51] Int. Cl.[6] ..... G04B 37/00; G04B 19/04

[52] U.S. Cl. ..... 368/88; 368/80; 368/223; 368/276; 368/281

[58] Field of Search ..... 368/88, 76, 80, 368/276, 294–296, 281–283, 297–300, 309–310

[56] References Cited

U.S. PATENT DOCUMENTS

| | | | |
|---|---|---|---|
| 301,928 | 7/1884 | Skidmore et al. | 368/299 |
| 2,253,715 | 8/1941 | Lux | 368/309 |
| 4,580,907 | 4/1986 | Cognard | 368/294 |
| 4,627,738 | 12/1986 | Kao | 368/281 |
| 4,796,240 | 1/1989 | Stevens | 368/281 |
| 5,018,118 | 5/1991 | Ross | 368/228 |
| 5,083,300 | 1/1992 | Schwartz | 368/185 |
| 5,392,261 | 2/1995 | Hsu | 368/281 |
| 5,592,443 | 1/1997 | Kasato et al. | 368/281 |
| 5,598,383 | 1/1997 | Li | 368/291 |

*Primary Examiner*—Vit Miska
*Attorney, Agent, or Firm*—Drummond & Duckworth

[57] ABSTRACT

A modular time piece including a time keeping mechanism, a time indicating casing and a band secured to the time indicating casing. The time keeping mechanism is easily engageable and disengageable to the time indicating casing to permit the time indicating casing and band to be selectively interchanged. The modular time piece farther includes a time setting stem and a retractable tab extending from the back of the time keeping mechanism. The retractable tab permits finger rotation of the time keeping mechanism relative to the time indicating casing during engagement and disengagement therebetween.

8 Claims, 4 Drawing Sheets

MODULAR TIME PIECE

BACKGROUND

The present invention relates to time pieces, and more particularly, to a time piece of the type and size that one would carry on their person, such as a wrist watch. Additionally, the present invention relates to time pieces that are capable of altering their appearance.

The great demand for watches of all kinds has lead to a variety of styles, shapes and colors employed to attract the consumer's interest. The advent of the latest watch fashions, technology, and the availability of different materials to be used in watch components has lead to a great diversity of the sizes, shapes and colors of watches. Moreover, in recent years there has been a great demand for watches which serve additional functions beyond telling time such as operating as a stop watch, operating as a depth gauge, indicating ambient barometric pressure, operating as a calculator, etc. Thus watches are now manufactured which possess a multiplicity of functions to suit a user's needs. Accordingly, many persons own several watches which are worn dependant on the functions desired for specific occasions.

Normally, watch cases are made self contained to form decoratively attractive packaged assemblies. Each visible watch element has come to be regarded as a candidate for contributing to the overall design of the watch, with such creative design treatment primarily being focused on the case, the watch dial and the strap or band. Since most watches are purchased in a fully assembled condition, it is necessary to have a different watch for distinctive occasions. For example, wearers must own numerous watches to match the wearer's watch to his or her clothing. Even though the cost of attractive watches has dropped dramatically over the past few years, the need to maintain a collection of several watches can become very expensive for the fashion conscious consumer.

To this end, numerous attempts have been made to provide a watch with an alterable appearance. For example, U.S. Pat. No. 4,742,503 discloses a watch design having an interchangeable bezel and interchangeable watch band. Unfortunately, the watch case and watch dial which comprise a majority of the watch's appearance is not interchangeable. Meanwhile, U.S. Pat. No. 1,539,781 discloses a watch having a frame adjacent to the dial face for displaying interchangeable cards, photographs, etc. Needless to say, the watch is bulky and cumbersome and still does not provide for the watch face being alterable. Similar in nature, U.S. Pat. No. 5,008,869 discloses a time piece having a replaceable dial. This watch has the drawback of not having a replaceable casing or watch band.

Still an additional attempt at creating an alterable time piece is disclosed in U.S. Pat. No. 4,796,240. This reference discloses a watch capable of replacing the dial face, watch hands, crystal and bevel. Again, this reference does not disclose a watch capable of completely altering its appearance. This watch is incapable of altering its casing or watch band.

None of the known prior art discloses a time piece capable of completely altering its appearance to meet the day to day needs of the user. Accordingly, a primary objective of the present invention is to allow the wearer of a watch or time piece flexibility in selecting the clock face styles, the watch case style, the appearance of the time indicators (watch hands) and the band or strap of the time piece to be worn.

An additional object of the invention is to allow the wearer to purchase only one time keeping mechanism and still provide a time piece capable of completely altering its appearance.

SUMMARY OF THE INVENTION

Briefly, and in general terms, the present invention addresses the aforementioned disadvantages by providing a modular time piece which enables a wearer to selectively replace the watch band and watch casing including the watch face, while utilizing only a single time keeping mechanism.

The modular time piece of the present invention includes a time indicating casing and a time keeping mechanism. The time indicating casing is of common construction and may be circular, oval, square or rectangular, subject to the desires of the wearer. The time indicating casing further includes a time indicating means, such as watch hands or the like, a watch face and a transparent shield for protecting the time indicating means. The watch hands may include an hour hand, minute hand, second hand and date. In addition, the time indicating means may display additional information, such as stop watch, depth gauge, calculator or the like.

The time keeping mechanism controls the operation of the time indicating means and is of the type generally known to those skilled in the art. For example, the time keeping mechanism may be battery powered, manually wound or self winding. An object of the present invention is that the time keeping mechanism releasably engages the time indicating casing in order that a single time keeping mechanism may be interchangeably swapped with several time indicating casings, according to the needs of the wearer. In a preferred embodiment, the time keeping mechanism includes a plurality of upwardly extending annular engagement shafts with each shaft controlling the corresponding rotating hands of the time indicating means. Similarly, the time indicating means (watch hands) include a plurality of downwardly extending annular engagement shafts configured to engage the upwardly extending shafts of the time keeping mechanism.

In a preferred embodiment, the engagement shafts of the time indicating means are formed with bores to form a press fit with the engagement shafts of the time keeping mechanism when pressed together. In an additional embodiment, the respective engagement shafts of the time indicating means and time keeping mechanism engage by a plurality of magnets. For example, the engagement shafts of the time keeping mechanism may include magnets of a negative polarity positioned upwardly, while the engagement shafts of the time indicating means may include magnets of positive polarity positioned downwardly such that the respective magnets will engage. As would be understood by those skilled in the art, the polarity of the magnets may be reversed between the respective engagement stems of the time keeping mechanism and time indicating means. Further, the polarity of the magnet may be switched as between the hour hand, minute hand and second hand of the respective shafts. Furthermore, each engagement shaft may include more than one magnet of different polarity in order to more effectively transmit rotational torque from the time keeping mechanism to the engagement shafts of the time indicating means. In still another preferred embodiment, the respective engagement shafts of the time keeping mechanism and time indicating means engage with roughened, knurled or notched surfaces thereby creating a high coefficient of friction between the respective engagement shafts to also thereby effectively transmit rotational torque.

The modular time piece of the present invention further includes a time piece band secured to the time indicating casing. In a preferred embodiment, the time piece band is a standard wrist watch band known to those skilled in the art having any number of design configurations. The invention is not limited to such a device, but could also take the form of a locket, necklace, pocket watch chain or numerous other forms enabling a user to wear or secure a time piece. In this manner, the time piece apparatus will be completely changed every time the time indication casing is swapped.

As described above, the present invention includes a time keeping mechanism which permits the time indicating casing and time piece band to be selectively interchanged. Securing the time keeping mechanism to the time indicating casing is a locking means for selectively securing and releasing the time keeping mechanism to the time indicating casing. Of importance, the time indicating casing engages and disengages with the time keeping mechanism with little effort, such that the user can easily swap the time indicating casing with simple finger manipulation or with simple tools. In a first embodiment, the locking means is a clasp which may be locked and released to enable engagement and disengagement of the time keeping mechanism to the time indicating casing. Preferably, the time indicating casing and time keeping mechanism include a plurality of corresponding alignment rods and bores, respectively. During engagement, the bores align for telescopic receipt of the alignment rods to aid in the proper engagement of the time keeping mechanism to the time indicating casing.

In a second preferred embodiment, the time keeping mechanism threadably engages the time indicating casing. In this configuration, the time keeping mechanism is cylindrical and includes an outwardly extending spiral thread on the outer extremity of its cylindrical surface. Meanwhile, the time indicating casing includes a cylindrical orifice with an inwardly extending spiral thread disposed therein and configured for rotational receipt of the time keeping mechanism.

In still another preferred embodiment, the time keeping mechanism includes an extendable and retractable tab. The tab is extendable from the back portion of the time keeping mechanism and is configured to enable a user to easily manually rotate the time keeping mechanism relative to the time indicating casing for engagement and disengagement therebetween.

Where the time indicating casing and time keeping mechanism treadably engage by relative rotation, a time setting stem positioned on the side of a time keeping mechanism would interfere during rotationable engagement. Accordingly, it is in additional object of the present invention that the time setting stem extends rearwardly from the back of the time keeping mechanism. In a preferred configuration, the extendable tab is centrally located on the back of the time keeping mechanism and includes a central notch portion to avoid interference with a centrally located time setting stem.

Other features and advantages of the present invention will be appreciated by those skilled in the art by reading the detailed description which follows with reference to the attached drawings.

BRIEF DESCRIPTION OF THE DRAWINGS

These and other features, aspects and advantages of the present invention will become better understood with regard to the following description, appended claims and accompanying drawings where:

DETAILED DESCRIPTION OF THE INVENTION

Figure 1:
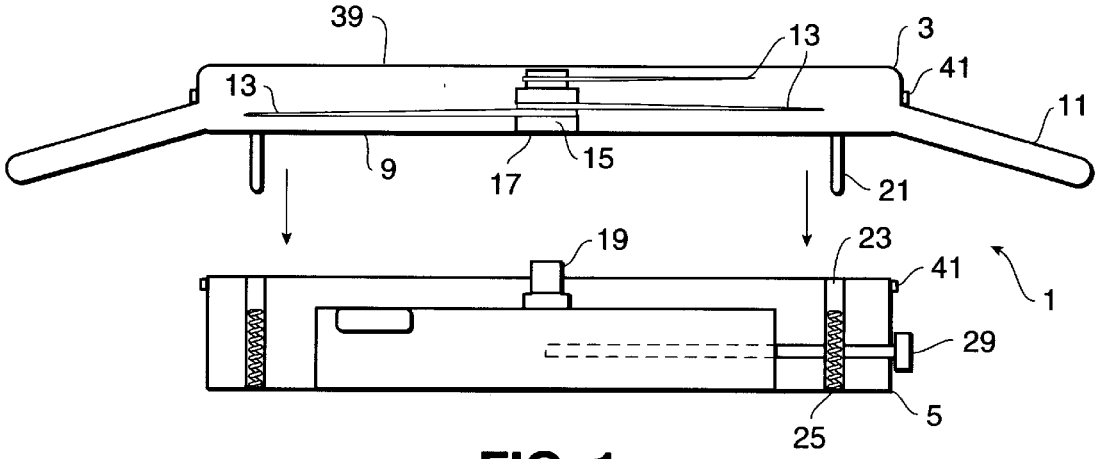
FIG. 1 is a side view of the modular time piece of the present invention including time indicating casing, time keeping mechanism and watch band.

While the present invention is susceptible of embodiment in various forms, there is shown in the drawings and will hereinafter be described a presently preferred embodiment of the invention with the understanding that the present disclosure is to be considered as an exemplification of the invention and is not intended to limit the invention to the specific embodiments illustrated.

Figure 2:
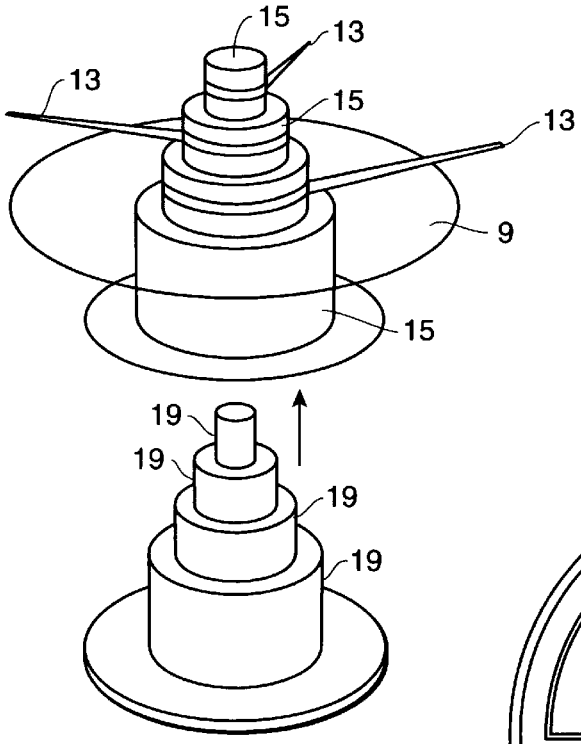
FIG. 2 is a side view of a preferred embodiment of the annular engagement shafts of the time indicating casing and time keeping mechanism.

The present invention provides for an improved modular time piece which enables a wearer to completely alter the time piece's appearance while utilizing only a single time keeping mechanism. Referring to FIGS. 1 and 2, the modular time piece 1 includes a time keeping mechanism 5, a time indicating casing 3 and a watch band 11 secured to the time indicating casing. The time indicating casing has the appearance of an ordinary watch casing commonly known by those in the art. For example, the casing may be circular, oval, square or rectangular and includes a watch dial 9 having a fanciful appearance of arbitrary design. Further, the casing may be of any rigid or semi-rigid material such as steel, aluminum, gold, silver or plastic.

In a preferred embodiment of the invention, the time indicating casing 3 includes a plurality of engagement shafts 15 telescoping through a bore formed in the watch dial 9. Extending tangentially from the engagement shafts 15 are time indicating means in the form of watch hands 13. The watch hands 13 may include an hour hand, minute hand, second hand and date indicator. Protecting the watch hands 13 is a transparent shield 39, preferably made of glass or plastic.

The time keeping mechanism 5 includes all the components necessary for maintaining the proper time of the modular time piece. These components are generally known to those skilled in the art and may include gearing that is battery powered, manually wound or self winding. As shown in FIGS. 1–5, the time keeping mechanism preferably includes a plurality of upwardly extending annular engagement shafts 19. Each of these annular engagement shafts 19 are independently rotatable and are configured to engage the corresponding annular engagement shafts 15 of the time indicating casing. Further, the time keeping mechanism includes a watch setting stem 29 for setting the time of the modular time piece. In a first embodiment, the time setting stem extends from the side of the time keeping mechanism 5 in ordinary fashion (FIG. 1). In a preferred embodiment, the time setting stem extends rearwardly from the back of the time keeping mechanism 5 such that the time setting stem is blocked from view when the modular time piece is worn by a user (FIGS. 3–6).

An object of the present invention is that the time keeping mechanism 5 and time indicating casing 3 are selectively engageable and disengageable from each other. In this manner, a single time keeping mechanism may be purchased, while numerous time indicating casings can then be selectively interchanged with the single time keeping mechanism to provide the wearer of the modular time piece the economic flexibility in selecting the style of the watch case, watch dial, watch hands, and watch band. As shown in FIGS. 1 and 2, in a first embodiment, the time indicating casing 3 is secured to the time keeping mechanism 5 by means of a securing clasp 41. The securing clasp may be of numerous designs commonly known to those skilled in the art.

In an additional embodiment, the modular time piece includes a plurality of alignment rods 21 and a corresponding number of alignment bores 23. As shown in FIG. 1, the time keeping mechanism includes a plurality of alignment bores 23 configured for telescopic receipt of alignment rods 21 extending rearwardly from the back of the time indicating casing. To aid in the disengagement of the time keeping mechanism 5 from the time indicating casing 3, springs 25 are disposed in the alignment bores 23. In this manner, disengagement of the securing clasp 41 effects relative displacement of the time keeping mechanism 5 to the time indicating casing 3.

Engagement of the annular engagement shafts 15 of the time indicating casing to the annular engagement shafts 19 of the time keeping mechanism can be determined by those skilled in the art without undo experimentation. As shown in FIGS. 1 and 2, the respective annular engagement shafts 15 of the time indicating casing 3 engage, and are affixed to, the annular engagement shafts 19 of the time keeping mechanism 5 by means of a press fit. In a second embodiment, the engagement shafts 19 of the time keeping mechanism are magnetized with the negative polarity positioned upwardly. Meanwhile the engagement shafts of the time indicating means are magnetized with the polarity positioned downwardly. As would be understood by those in the art, the polarity between the respective magnets can be reversed between the respective engagement shafts of the time indicating means and time keeping mechanism. Furthermore, the torque transmitted by the time keeping mechanism engagement shafts 19 can be increased by including a plurality of magnets of opposite polarity to engage corresponding magnets positioned in the engagement shafts of the time indicating casing.

Figure 3:
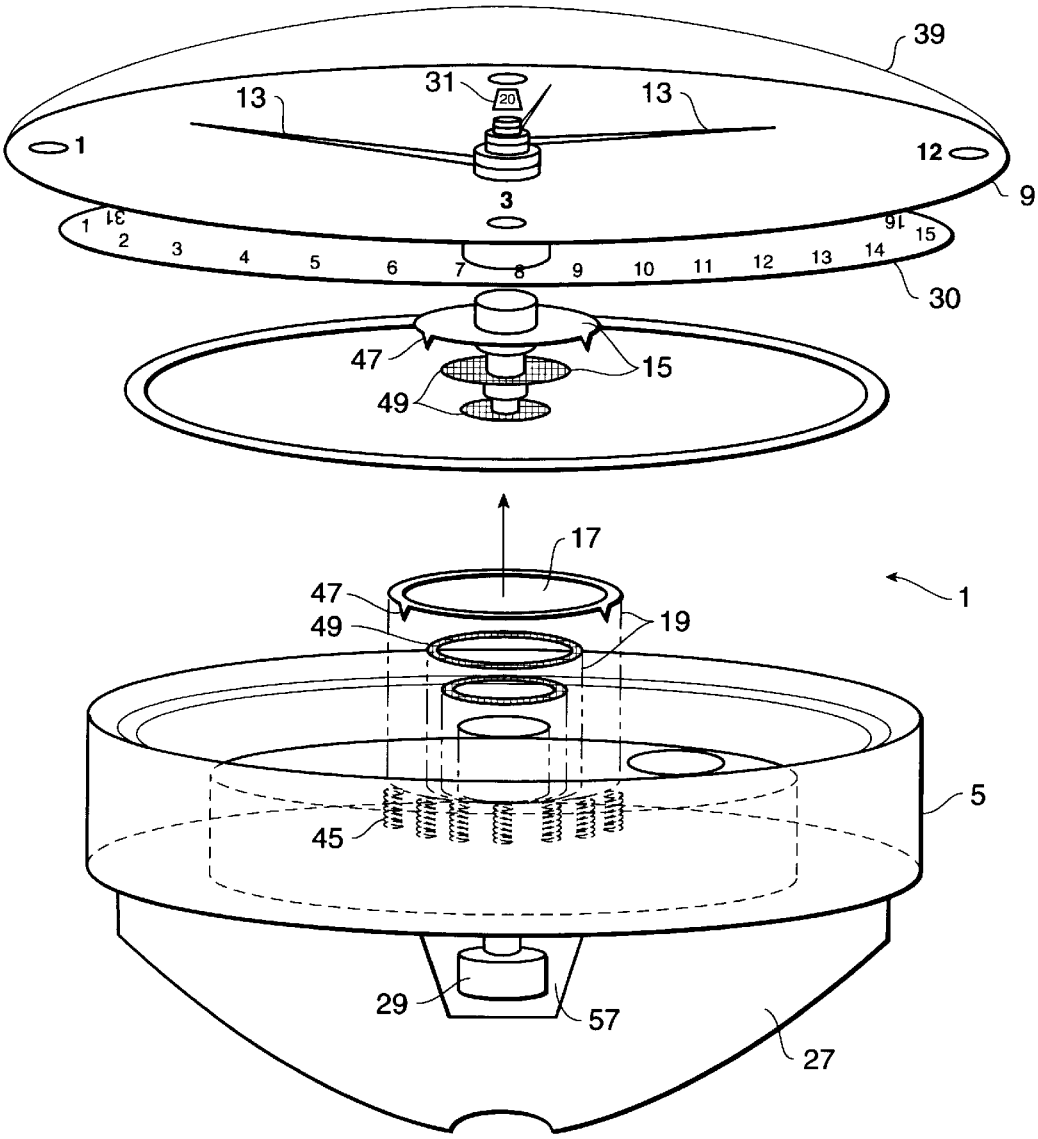
FIG. 3 is a side exploded view of a preferred embodiment of the internal components of the modular time piece of the present invention.

As shown in FIGS. 1 and 2, in a preferred embodiment, the annular engagement shafts 19 of the time keeping mechanism 5 are received in circular orifices formed in the engagement shafts 15 of the time indicating casing 3. However, as shown in FIG. 3, the annular engagement shafts 19 of the time keeping mechanism can similarly include circular orifices 7 to receive and engage the annular engagement shafts 15 of the time indicating casing 3. In a further embodiment of the invention, the annular engagement shafts rest on one or more engagement springs 45. The engagement springs 45 compress during engagement of the time indicating casing to the time keeping mechanism to insure proper engagement between the annular engagement shafts 15 and 19. As shown in FIG. 3, engagement may also be achieved by notches 47 or roughened or knurled surfaces 49 between the respective engagement shafts to thereby increase the coefficient of friction to thereby transmit rotational torque.

Figure 5:
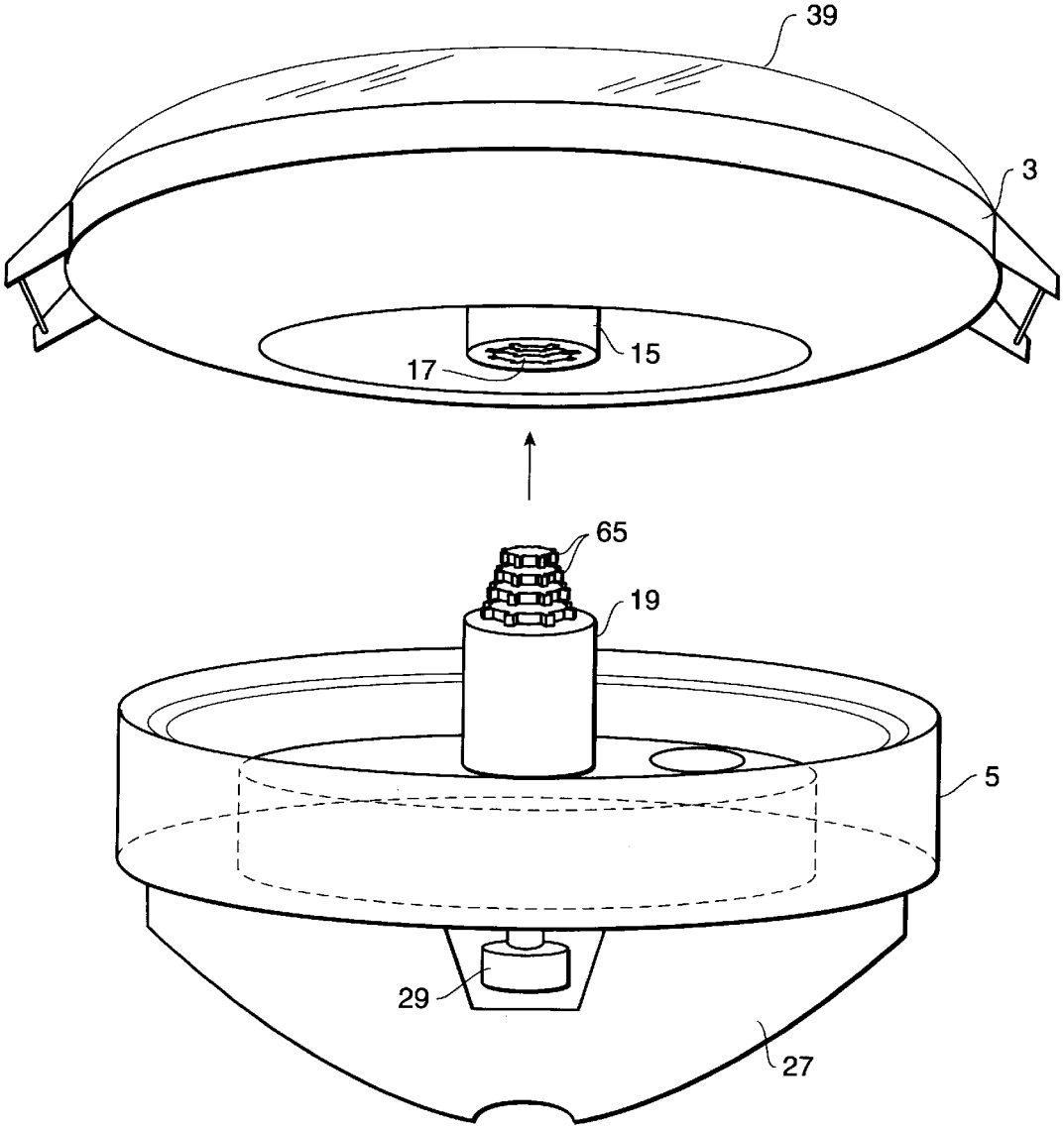
FIG. 5 is a side view of a preferred embodiment of the time indicating casing and the time keeping mechanism of the present invention.

Referring to FIG. 5, in an additional embodiment, the annular engagement shafts 19 of the time keeping mechanism 5 include a plurality of cogs 65. Meanwhile, the annular engagement shafts 15 of the time indicating casing 3 are formed to receive the cogs 65 such that rotation of the respective cogs operates to rotate the corresponding annular engagement shafts 15 and accordingly the watch hands 13 to display the proper time.

In still another embodiment, the time keeping mechanism threadably engages the time indicating casing. In this embodiment, the time keeping mechanism is preferably cylindrical and includes an outwardly extending spiral thread (not shown) formed on the outer extremity of its cylindrical surface. Meanwhile, the time indicating casing includes an inwardly extending spiral thread configured for rotational receipt of the time keeping mechanism. Referring to FIGS. 3–6, to aid user in treading the time keeping mechanism to the time indicating casing, the time indicating mechanism includes an extendable and retractable tab 27. The tab is extendable from the back portion of the time keeping mechanism 5 to enable a user to use his fingers to rotate the time keeping mechanism to engage the threads of the time indicating casing. When the modular time piece is being worn, the tab retracts into a recess 61 in the back of the time keeping mechanism to a low profile.

Figure 4:
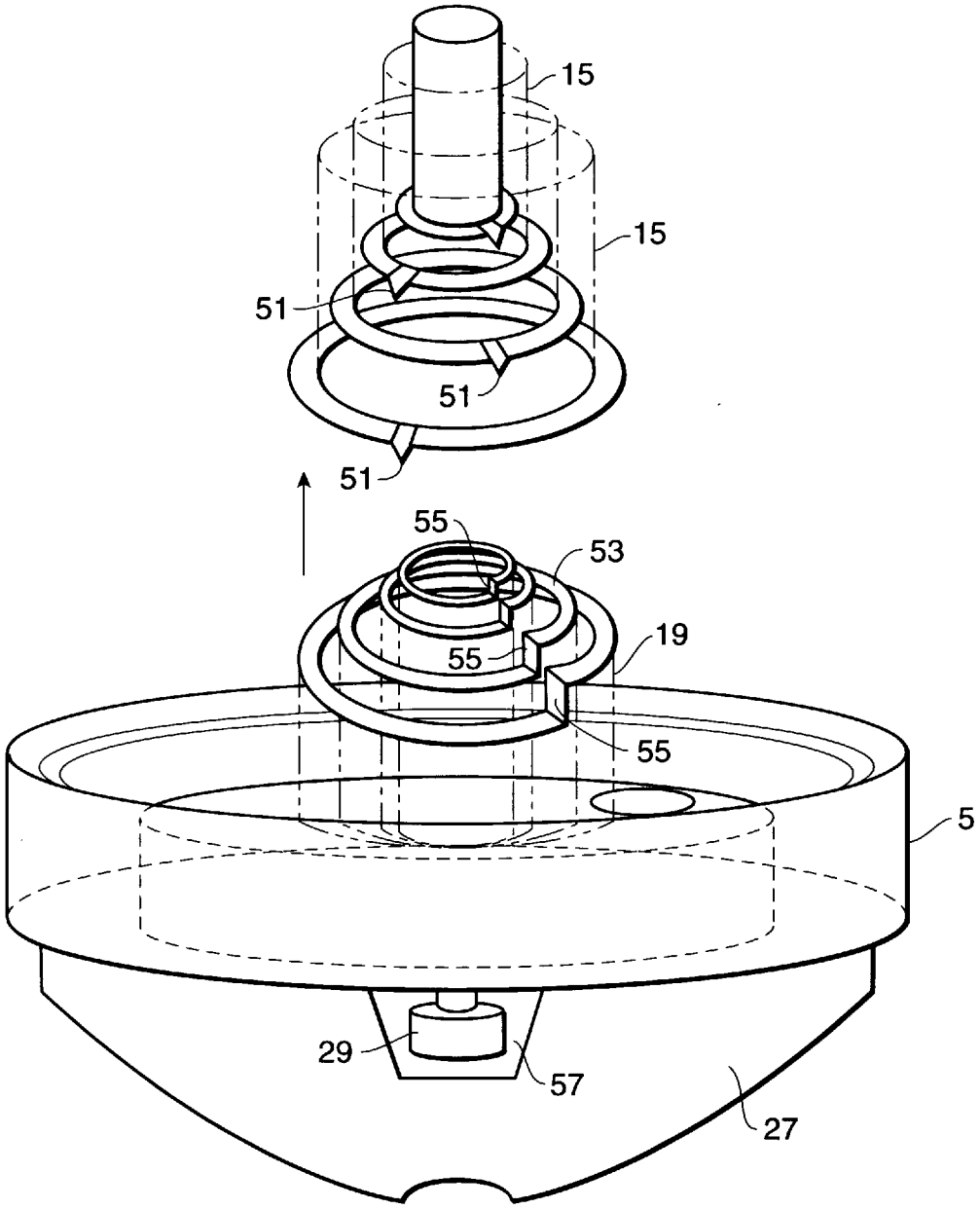
FIG. 4 is a side exploded view of another preferred embodiment of the internal components of the modular time piece of the present invention.

In a most preferred embodiment, the time indicating hands 13 and date keeper 30 are automatically set to the correct date and time upon engagement of the time keeping mechanism to the time indicating casing. The time keeping mechanism continues to operate and keep the correct time even in the absence of engagement to the time indicating casing. The present invention provides for the hand 13 and date keeper 30 to automatically align to display the proper time and date upon engagement of the time keeping mechanism. Referring to FIG. 4, the annular engagement shafts 19 of the time keeping mechanism include a spiral configuration. Meanwhile, the annular engagement shafts 15 of the time indicating means include a single nub or protuberance 51. As the time keeping mechanism is rotated to threadably engage the time indicating casing, the edges 55 of the spiral engagement shafts 19 engage the protuberances 51. The hands and date keeper are then rotated as the time keeping mechanism is rotated during engagement of the time keeping mechanism to the time indicating casing. As long as relative rotation of the time keeping mechanism to the time indicating casing is always the same at full engagement, the watch hands and time keeper will always display the correct time and date.

Figure 6:
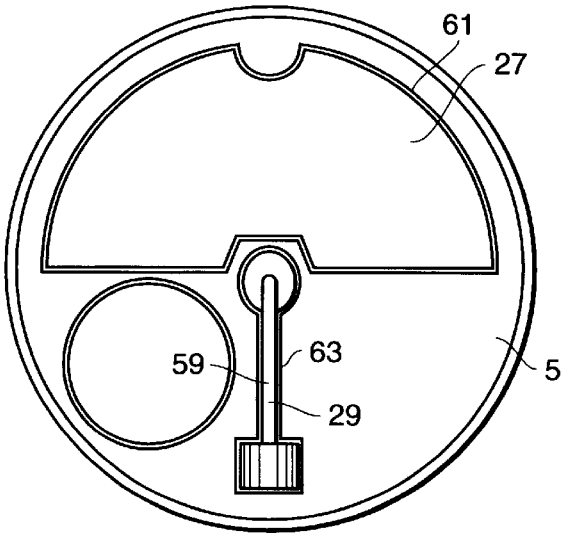
FIG. 6 is a side exploded view of the back of a preferred embodiment of the time keeping mechanism.

Prior art watches generally include a time setting stem extending from the side of the time keeping mechanism (FIG. 1). Referring to FIGS. 3–6, it is an object of the present invention that the time setting stem 29 extend from the back of the time keeping mechanism 5. The time setting stem 29 is centrally located in the back of the time indicating mechanism and projects through a notch 57 formed in the extendable tab 27. In another embodiment, the time setting stem 29 further includes a lever arm 59 which retracts and extends from a lever arm recess 63 (FIG. 6).

While several particular forms of the invention have been illustrated and described, it will be apparent that various modifications can be made without departing from the spirit and scope of the invention. Accordingly, it is not intended that the invention be limited, except by the appended claims.

We claim:

1. A modular time piece comprising:

a) a time indicating casing including a front, a back, a time indicating means, and a transparent shield means for protecting said time indicating means;

b) a time piece band for securing the modular time piece to a user, said time piece band secured to said time indicating casing;

c) a time keeping mechanism for controlling said time indicating means, said time keeping mechanism releasably engaging said time indicating casing; and d) a locking means for securing said timekeeping mechanism to said time indicating casing.

2. The modular time piece of claim 1 wherein said time keeping mechanism threadably engages said time indicating casing.

3. The modular time piece of claim 2 wherein said time keeping mechanism further includes a tab for manual rotation of said time keeping mechanism for engagement and disengagement with said time indicating casing.

4. A modular time piece of claim 3 wherein said tab is retractable into said back of said time keeping mechanism.

5. The modular time piece of claim 1 wherein said time indicating casing includes a plurality of alignment rods, and said time keeping mechanism includes a plurality of alignment bores configured for telescopic receipt of said alignment rods.

6. The modular time piece of claim 1 wherein said time keeping mechanism includes a plurality of alignment rods, and said time indicating casing includes a plurality of alignment bores configured for telescopic receipt of said alignment rods.

7. The modular time piece of claim 1 further including a time setting stem projecting rearwardly from said back of said time keeping mechanism.

8. The modular time piece of claim 1, wherein said time indicating means automatically displays the correct time after engagement of said time keeping mechanism to said time indicating casing.

* * * * *